US010135169B1

(12) United States Patent
Shimoju et al.

(10) Patent No.: US 10,135,169 B1
(45) Date of Patent: Nov. 20, 2018

(54) ELECTRICAL CONNECTOR WITH INDEPENDENTLY BIASABLE CONDUCTING TERMINALS

(71) Applicant: ACES ELECTRONICS CO., LTD., Taoyuan (TW)

(72) Inventors: Toshiharu Shimoju, Taoyuan (TW); Wang-Kun Tsai, Taoyuan (TW)

(73) Assignee: ACES ELECTRONICS CO., LTD, Taoyuan (TW)

( * ) Notice: Subject to any disclaimer, the term of this patent is extended or adjusted under 35 U.S.C. 154(b) by 0 days.

(21) Appl. No.: 15/926,037

(22) Filed: Mar. 20, 2018

(51) Int. Cl.

| | |
|---|---|
| ***H01R 12/00*** | (2006.01) |
| ***H01R 13/24*** | (2006.01) |
| ***H01R 13/504*** | (2006.01) |
| ***H01R 12/77*** | (2011.01) |

(52) U.S. Cl.
CPC ..... *H01R 13/2428* (2013.01); *H01R 12/777* (2013.01); *H01R 13/504* (2013.01)

(58) Field of Classification Search
CPC ..... H01R 23/7068; H01R 23/725; H01R 23/6886; H01R 23/7005; H01R 31/06
USPC ..... 439/62, 74, 631, 633, 637, 638
See application file for complete search history.

(56) References Cited

U.S. PATENT DOCUMENTS

| | | | | |
|---|---|---|---|---|
| 7,018,224 | B2 * | 3/2006 | Reisinger | H05K 1/0259 439/181 |
| 7,172,465 | B2 * | 2/2007 | Kinsley | H01R 12/58 439/632 |
| 7,455,531 | B2 * | 11/2008 | Hirabayashi | H01R 13/025 174/154 |
| 8,298,009 | B2 * | 10/2012 | Elkhatib | H01R 12/594 439/581 |
| 8,979,550 | B2 * | 3/2015 | Law | G01R 31/2818 439/62 |
| 9,433,094 | B2 * | 8/2016 | Kashiwakura | H01R 12/721 |

* cited by examiner

*Primary Examiner* — Phuong Chi T Nguyen
(74) *Attorney, Agent, or Firm* — Muncy, Geissler, Olds & Lowe, P.C.

(57) ABSTRACT

An electrical connector includes an electrically insulative housing including a front base, a back cover and a floating structure exposed to the outside of an accommodation chamber between the front base and the back cover, and a contact conducting structure including a flexible PC board, multiple conducting terminals electrically connected to respective contacts at the flexible PC board, a support block having fingers respectively extended from respective spring arms thereof for supporting the flexible PC board and spring members supporting the respective fingers. The flexible PC board has slits respectively disposed between each two adjacent contacts so that the conducting terminals can be independently biased with the respective contact without affecting the conducting stability, making the electrical connector practical for high frequency application.

10 Claims, 8 Drawing Sheets

ELECTRICAL CONNECTOR WITH INDEPENDENTLY BIASABLE CONDUCTING TERMINALS

BACKGROUND OF THE INVENTION

1. Field of the Invention

The present invention relates to electrical connector technology, and more particularly to an electrical connector with independently biasable conducting terminals, which comprises an electrically insulative housing, and a contact conducting structure comprising a flexible PC board, conducting terminals bonded to respective contacts of the flexible PC board, a support block supporting the flexible PC board and a plurality of spring members supporting the support block. The flexible PC board has slits respectively defined between each two adjacent contacts thereof so that the conducting terminals are independently biasable with the respective contacts, making the electrical connector practical for high frequency application.

2. Description of the Related Art

Nowadays, with the rapid development of electronic technology, the computer type has evolved from desktop computer into smaller and more portable notebook computer, ultra-thin notebook computer, tablet computer, and the like that are commonly found in every corner of the society. Further, the design of electronic devices tends to be light, thin, short and small. In order to reduce the size of an electronic device, the size of the internal components of the electronic device needs to be more miniaturized and precise, and the overall structural strength also needs to be strengthened to meet the current trend of electronic devices.

Furthermore, with the trend of development of electronic devices such as notebooks and ultra-thin type notebook computers, the internal space of the notebooks too small to accommodate a large number of functional components. Expansion devices or peripheral apparatus can be connected to a notebook to enhance its function for running a PC operating system. There are also commercially available notebooks with a detachable keyboard dock. After separation of the keyboard dock, the notebook is used as a tablet computer. A tablet computer can also be used with a detachable expansion dock or keyboard dock. For the connection between a tablet computer and an expansion dock or keyboard dock, a precision interface is necessary. In addition to the current connector design more and more miniaturization, the transmission speed and bandwidth requirements are getting higher and higher, in contrast, the problems caused by high-frequency signal transmission is endless.

With the increase of the number of conducting terminals and the more denser distribution of the conducting terminals, it is easy to grow electromagnetic waves and crosstalk interference caused by high frequency signal transmission when the adjacent terminals are too close together. This signal interference problem will be more serious with fast development of small size connectors.

A conventional probe or pogo pin connector generally comprises an insulating housing, and a plurality of pogo pins and contact terminals assembled forward in the insulating housing respectively. A pogo pin generally comprises a jacket, a spring within the jacket, a plug located within the jacket and a contact element located in the jacket. The mechanical characteristic of a pogo pin connector allows the pogo pins to be independently moved. Subject to the contact force provided by the spring, the contact element is kept in positive contact with the mating connector. Thus, a pogo pin has the advantages of small pitch between contacts, space saving, low resistance, high stability and long service life. For high frequency application, a connector is used with a thin thickness of coaxial wire, and the mating flexible PC board must provide a common ground connection design, for example, a flat grounding rod transversely mounted at the coaxial wire, or a grounding plate in the flexible PC board, enabling the high-frequency characteristics parameters to meet the application requirements. Contact pins of a connector can be connected to respective contacts of a flexible PC board by clamping or soldering. In order to maintain contact characteristics, the contacts of a flexible PC board are normally arranged in a block. After connection of the contact pins of a connector to the respective contacts of a flexible PC board, the contact pins of the connector cannot be independently moved with the respective contact of the flexible PC board while maintaining conduction stability. Thus, it is difficult to meet high-frequency application requirements. An improvement in this regard is necessary.

SUMMARY OF THE INVENTION

The present invention has been accomplished under the circumstances in view. It is therefore the main object of the present invention to provide an electrical connector with independently biasable conducting terminals comprises an electrically insulative housing and a contact conducting structure. The electrically insulative housing comprise a front base, a back cover fastened to the front base, an accommodation chamber defined between the front base and the back cover, and a floating structure exposed to the outside of the accommodation chamber. The contact conducting structure comprise a flexible PC board, multiple conducting terminals electrically connected to respective contacts at the flexible PC board, a support block comprising a plurality of spring arms arranged in a row, a plurality of fingers respectively extended from the spring arms for supporting the flexible PC board, and spring members supporting the respective fingers. The flexible PC board has slits respectively disposed between each two adjacent contacts so that the conducting terminals can be independently biased with the respective contact without affecting the conducting stability, making the electrical connector practical for high frequency application.

According to another aspect of the present invention, the floating structure comprises a first sliding member and a second sliding member disposed in a top open side of the accommodation chamber. The first sliding member comprises an elongated slot. The second sliding member comprises a plurality of through holes arranged in a row and exposed to the elongated slot of the first sliding member, a position-limiting wall curving downwardly from a back side thereof, and a plurality of position-limiting slots defined in the position-limiting wall corresponding to the respective through holes. The conducting terminals have respective contact portions thereof respectively upwardly inserted into the through holes of the second sliding member. The fingers of the support block have respective stop end portions thereof respectively inserted into the position-limiting slots of the second sliding member. When the conducting terminals are pushed, the fingers of the support block are forced downwardly to compress the respective spring members, and the matching arrangement between the stop end portions and the respective position-limiting slots enables the conducting terminals to be biased within a limited range without affecting conducting stability.

According to still another aspect, when the conducting terminals are pushed to move the fingers of the support block against the respective spring members, the fingers prohibit direct contact between the flexible PC board and the spring members, preventing the spring members from rubbing against the flexible PC board to force the contacts away from the respective conducting terminal or to cause a short circuit. Further, the fingers are supported on the respective arched spring arm for biasing, avoiding stress concentration to damage the structure. The arch chamfer design of the large radius of curvature of the arched spring arms mates with the flexibility of the flexible PC board allows the flexible PC board to be flexibly curved without causing damage.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
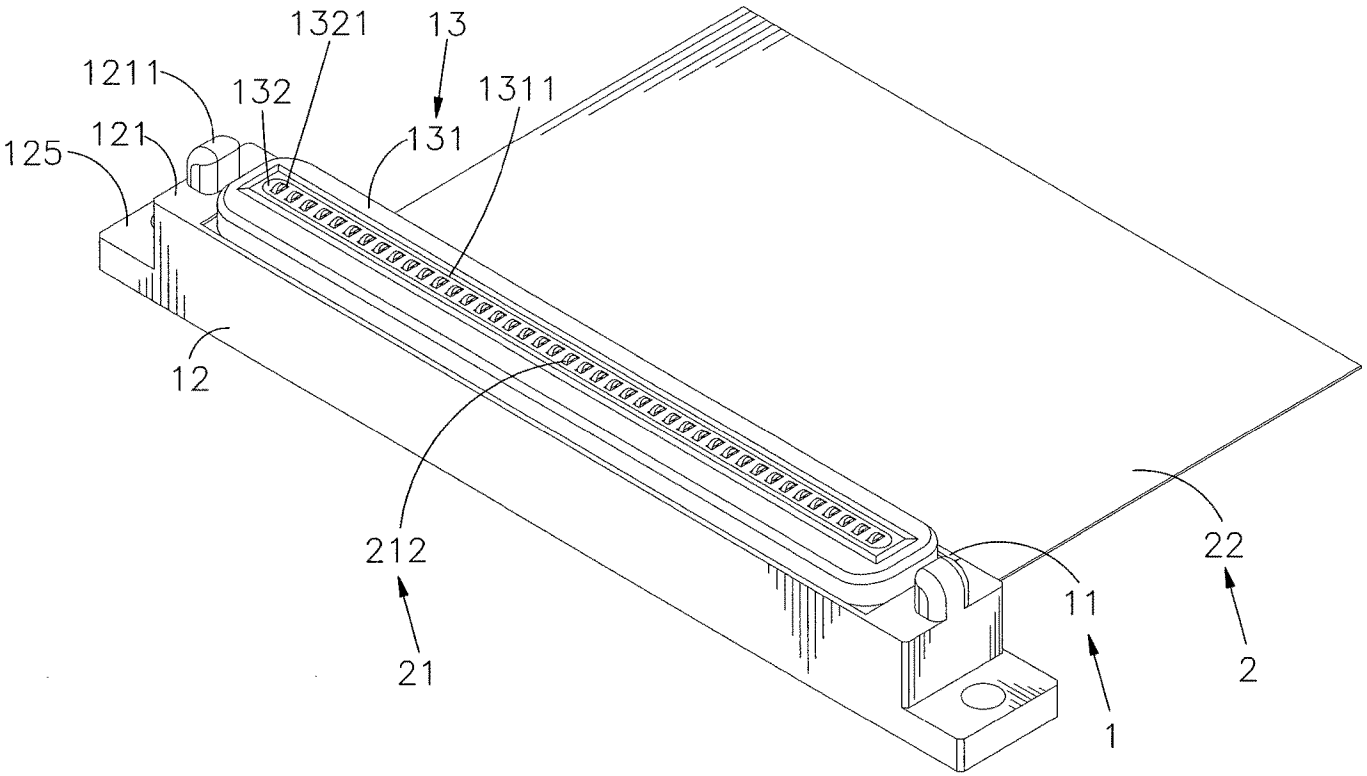
FIG. 1 is an oblique top elevational view of an electrical connector in accordance with the present invention.
Figure 2:
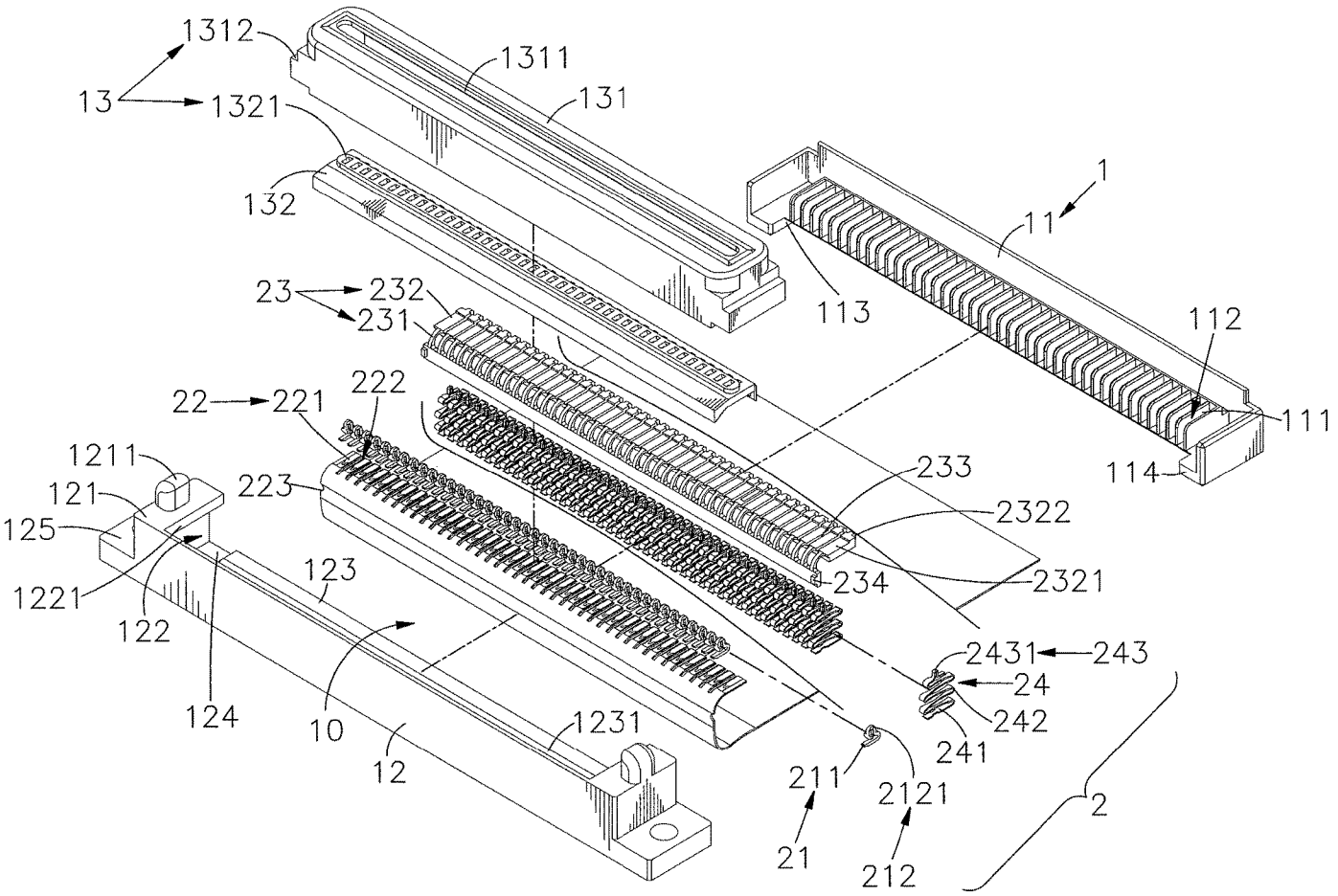
FIG. 2 is an exploded view of the electrical connector in accordance with the present invention.
Figure 3:
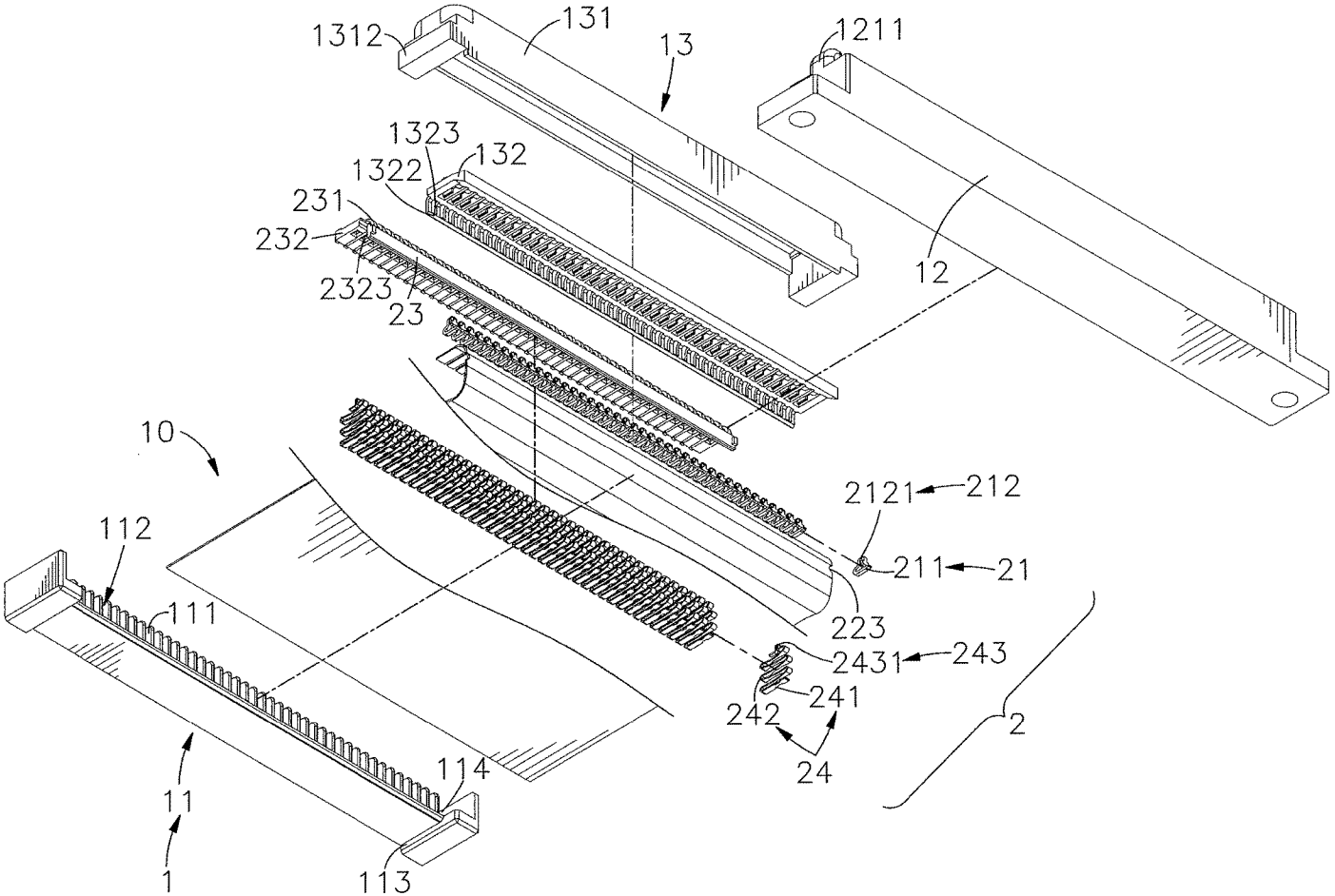
FIG. 3 corresponds to FIG. 2 when viewed from another angle.
Figure 4:
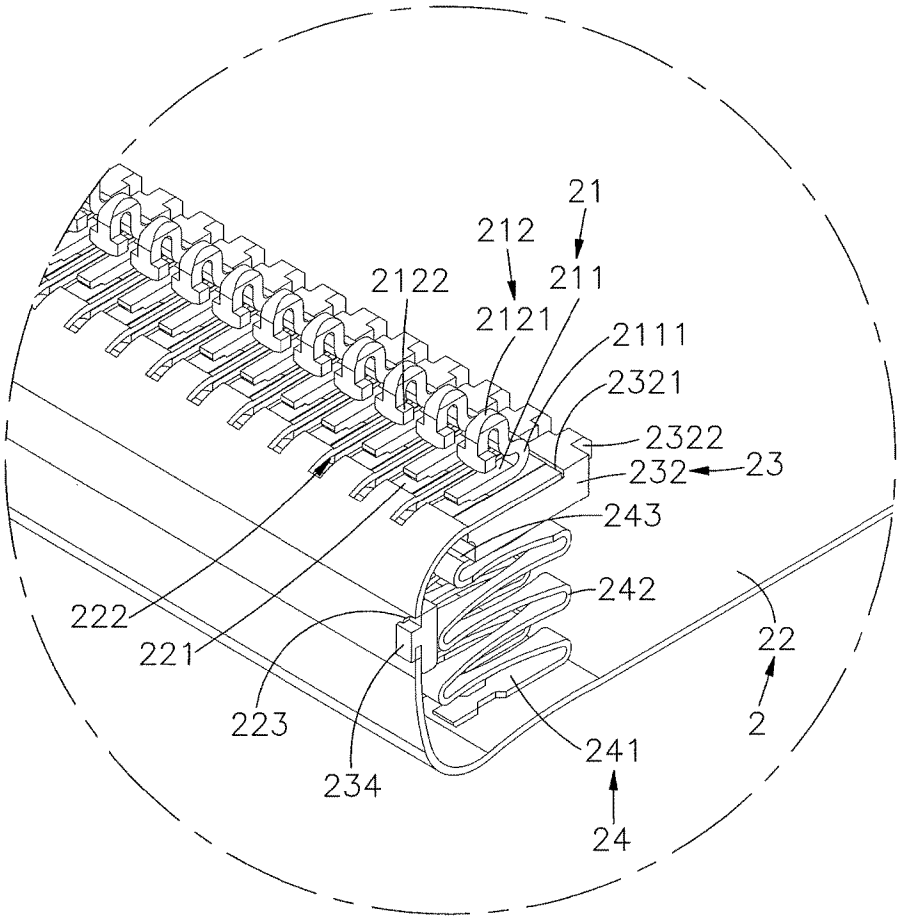
FIG. 4 is an elevational view, in an enlarged scale, of a part of the present invention, illustrating the structural details of the contact conducting structure.
Figure 5:
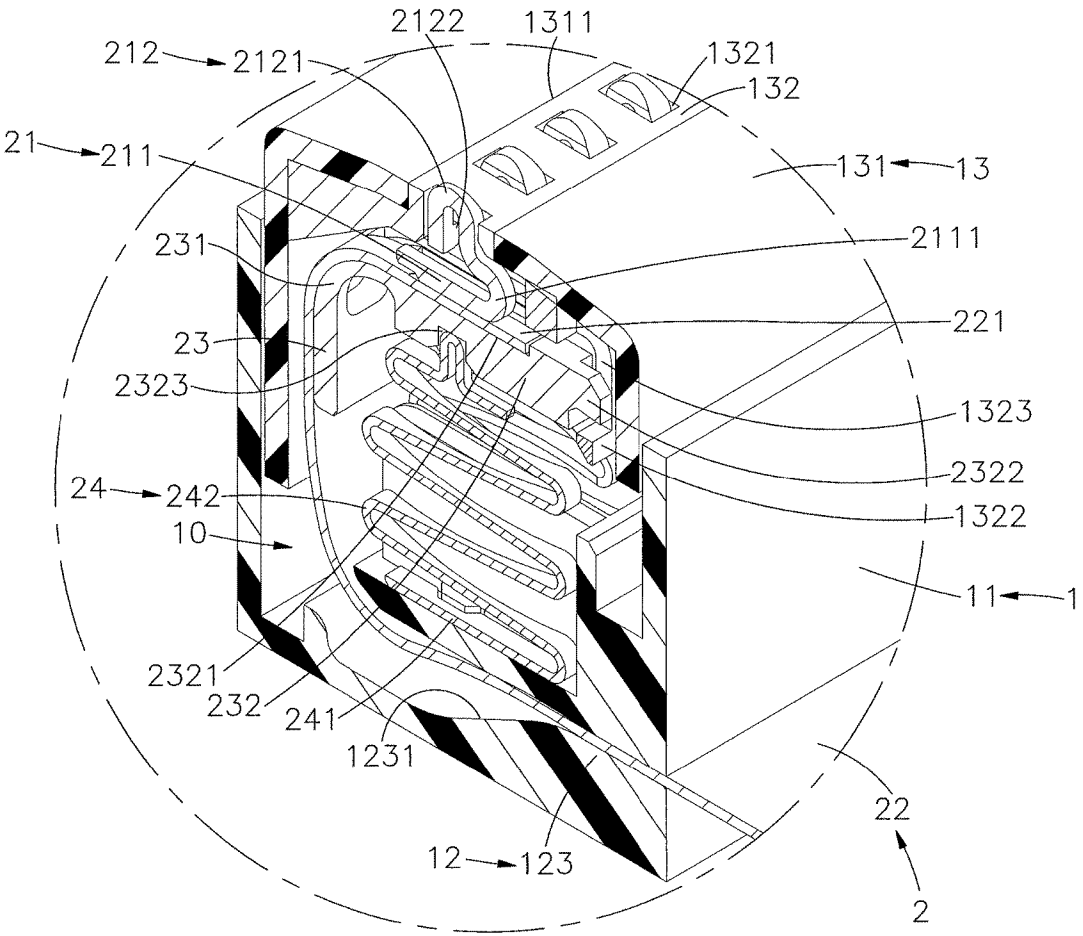
FIG. 5 is a sectional elevation, in an enlarged scale, of a part of the electrical connector in accordance with the present invention.

Referring to FIGS. 1-5, an electrical connector with independently biasable conducting terminals in accordance with the present invention is shown. The electrical connector comprises an electrically insulative housing 1 and a contact conducting structure 2.

The electrically insulative housing 1 comprises a front base 11, a back cover 12 fastened to the front base 11, an accommodation chamber 10 defined between the front base 11 and the back cover 12, and a floating structure 13 disposed in a top open side of the accommodation chamber 10 between the front base 11 and the back cover 12. The front base 11 comprises a plurality of spacer plates 111 arranged in a row at a top side between two opposite ends thereof to face toward the back cover 12, a compartment 112 defined between each two adjacent spacer plates 111, a bottom open chamber 113 defined in a bottom side thereof, and two guide rails 114 arranged in parallel at two opposite sides of the bottom open chamber 113.

The back cover 12 comprises a top abutment surface 121, two positioning posts 1211 upwardly extended from the top abutment surface 121 and respectively disposed at two opposite ends thereof, a positioning chamber 122 adapted for the positioning of the front base 11, two upright stop walls 1221 respectively disposed at two opposite sides of the positioning chamber 122 and abutted to the top abutment surface 121, a raised portion 123 disposed in the positioning chamber 122 to face toward the bottom open chamber 113, a concave surface 1231 located on a front side of the raised portion 123, two rail grooves 124 respectively disposed at two opposite sides of the raised portion 123 for receiving the respective guide rails 114, and two mounting portions 125 respectively extended from two opposite ends thereof.

The floating structure 13 comprises a first sliding member 131 protruding over the top abutment surface 121 of the back cover 12, and a second sliding member 132 joined to an inner side of the first sliding member 131. The first sliding member 131 comprises an elongated slot 1311 cut through opposing top and bottom sides and extending along the length thereof, and two stop blocks 1312 respectively disposed at two opposite ends thereof for stopping against the upright stop walls 1221. The second sliding member 132 is mounted in the first sliding member 131 and partially upwardly protruding over the elongated slot 1311, comprising a plurality of through holes 1321 cut through opposing top and bottom sides thereof and arranged in a row along the length thereof, a position-limiting wall 1322 curving downwardly from a back side thereof, and a plurality of position-limiting slots 1323 defined in the position-limiting wall 1322 corresponding to the respective through holes 1321.

The contact conducting structure 2 comprises a plurality of conducting terminals 21, a flexible PC board 22, a support block 23 and a plurality of spring members 24. Each conducting terminal 21 comprises a base portion 211, a contact portion 212 of an inverted U-shaped portion 2121, a turn-back portion 2111 connected between the base portion 211 and the inverted U-shaped portion 2121, and two abutment tips 2122 bilaterally extended from a distal end of the inverted U-shaped portion 2121. The flexible PC board 22 comprises an insulation layer, a circuitry formed of a copper foil on the insulation layer, a metal surface connected with the circuitry to form a common ground, a plurality of contacts 221 arranged in a row (or in two rows in a staggered manner) and respectively connected to the circuitry and/or metal surface to create an electrical conduction path, a slit 222 located on a front side thereof and defined between each two adjacent contacts 221, and two notches 223 bilaterally disposed at a rear side relative to the slits 222. The base portions 211 of the conducting terminals 21 are respectively bonded to the contacts 221 of the flexible PC board 22. In actual application, the conducting terminals 21 can be respectively electrically to the contacts 221 of the flexible PC board 22 by clamping, riveting laminating or other technology.

The support block 23 is mounted to one side of the flexible PC board 22 opposite to the conducting terminal 21, comprising a plurality of arched spring arms 231 arranged in a row, a plurality of fingers 232 respectively and horizontally extended from respective top ends of the arched spring arms 231, a spacing 233 defined between each two adjacent fingers 232, and two protruding retaining portions 234 respectively located on two opposite ends thereof below the elevation of the arched spring arms 231. Each finger 232 comprises a mounting surface 2321 located on a top side thereof, a stop end portion 2322 located on a center of rear side of the finger 232, and a positioning groove 2323 located on a bottom side of the finger 232.

In installation, the front side of the flexible PC board 22 is attached to the fingers 232 of the support block 23 and then bonded to the mounting surfaces 2321 of the fingers 232 with an adhesive, keeping the contacts 221 and the connected conducting terminals 21 in alignment with the respective fingers 232 and the slits 222 in alignment with the spacings 233. Thereafter, the protruding retaining portions 234 of the support block 23 are respectively fastened to the respective notches 223 of the flexible PC board 22. Thus, the arched design of the arched spring arms 231 mates with the flexible PC board 22 to create a large radius of curvature.

Further, the spring members 24 are respectively arranged to support the fingers 232 of the support block 23, Each spring member 24 comprises a first bearing portion 241 horizontally disposed at a bottom side thereof, a second bearing portion 243 horizontally disposed at an opposing top side thereof, a continuous S-shaped elastic portion 242 connected between the first bearing portion 241 and the second bearing portion 243, and an inverted U-shaped buckle end 2431 protruded from the second bearing portion 243 and engaged in the positioning groove 2323 of one respective finger 232. Thus, the spring members 24 elastically support the respective fingers 232, allowing the conducting terminals 21 to float with the flexible PC board 22 above the support block 23.

When mounting the contact conducting structure 2 in the accommodation chamber 10 of the electrically insulative housing 1, position the first bearing portions 241 of the spring members 24 in the respective compartments 112 of the front base 11, and then curve the flexible PC board 22 and insert the curved flexible PC board 22 through the bottom open chamber 113 of the front base 11 to keep the conducting terminals 21 beneath the second sliding member 132 of the floating structure 13, and then insert the stop end portions 2322 of the fingers 232 of the support block 23 into the position-limiting slots 1323 in the position-limiting wall 1322, and then press down the first sliding member 131, enabling the inverted U-shaped portions 2121 of the conducting terminals 21 to be upwardly inserted through the respective through holes 1321 of the second sliding member 132 and the abutment tips 2122 of the to be stopped a respective bottom sides of the respective through holes 1321. Thus, the second sliding member 132 is secured to the conducting terminals 21 and the support block 23.

Thereafter, install the back cover 12 in the front base 11 to force the rail grooves 124 of the back cover 12 into engagement with the respective guide rails 114 of the front base 11, enabling the floating structure 13 and the contact conducting structure 2 to be accommodated in the positioning chamber 122 of the back cover 12. At this time, the support block 23 is supported on the spring members 24, the stop blocks 1312 of the first sliding member 131 are respectively movably stopped at the respective upright stop walls 1221. After insertion of the flexible PC board 22 through the gap between the bottom open chamber 113 and the raised portion 123, the installation is done.

Figure 6:
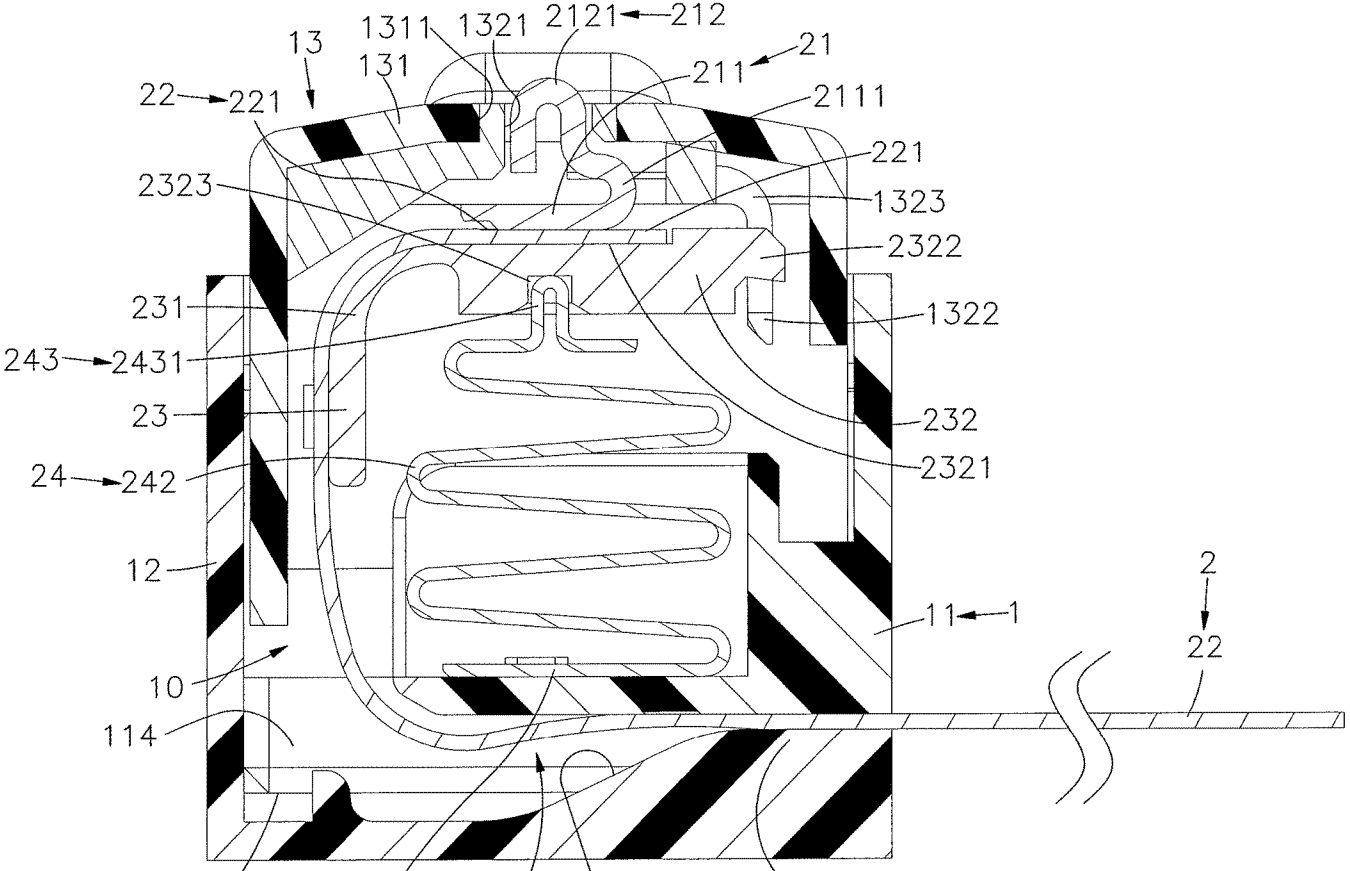
FIG. 6 is a sectional side view of the electrical connector in accordance with the present invention.
Figure 7:
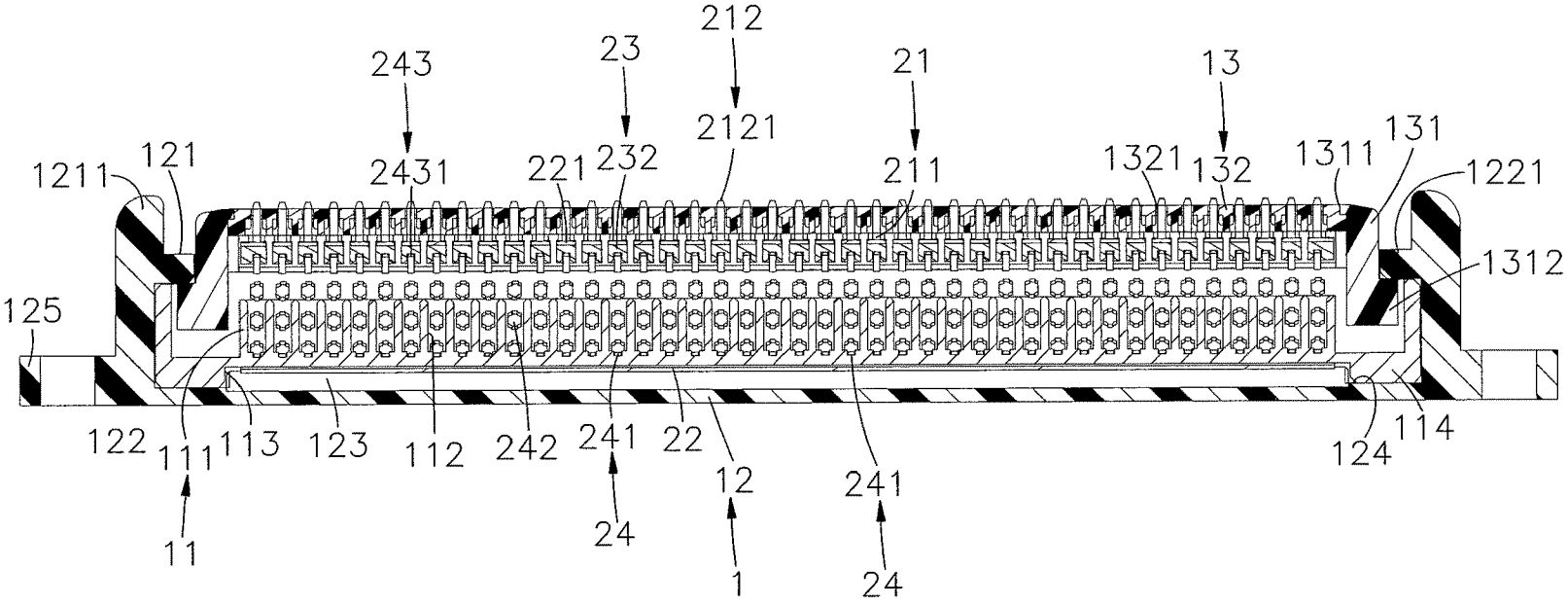
FIG. 7 is a sectional front view of the electrical connector in accordance with the present invention.
Figure 8:
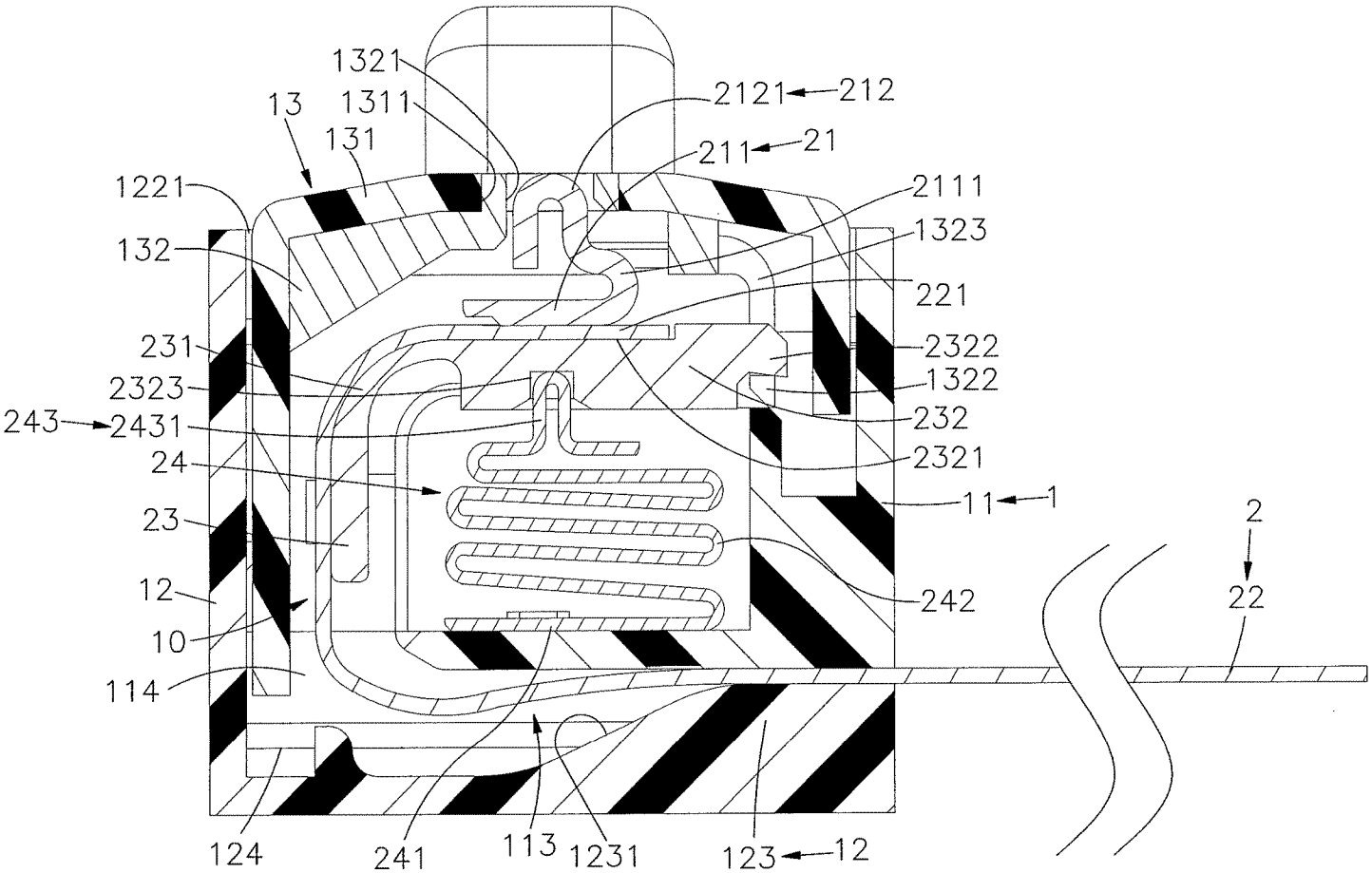
FIG. 8 is a sectional applied view of the present invention.

Referring to FIGS. 6-8, the electrical connector consisting of the electrically insulative housing 1 and the contact conducting structure 2 can be mounted in an expansion device, a charger block, a transmission block, or a keyboard housing. After mounting, the flexible PC board 22 is electrically connected to the control system for the connection of a mating electrical connector of a notebook computer, tablet computer or other electronic apparatus for power and signal transmission.

When connecting a mating external electrical connector to the electrically insulative housing 1 and the contact conducting structure 2, the contact portions 212 of the conducting terminals 21 are forced by the mating conducting terminal of the mating external electrical connector to bias the flexible PC board 22 and the fingers 232 of the support block 23 downwardly against the respective arched spring arms 231, causing the fingers 232 to compress the respective spring members 24. When the conducting terminals 21 are forced downwards, the second sliding member 132 of the floating structure 13 is moved downward, forcing the first sliding member 131 into the positioning chamber 122 of the back cover 12. Once the mating external electrical connector is abutted to the top abutment surface 121 of the back cover 12, the contact portions 212 of the conducting terminal 21 are forced into contact with the respective mating conducting terminals of the mating external electrical connector to achieve electrical conduction. The structural design of the inverted U-shaped portions 2121 of the conducting terminal 21 reduces friction between the contact portions 212 of the conducting terminal 21 and the respective mating conducting terminals of the mating external electrical connector, minimizing high-current or high-frequency signal transmission impedance and temperature rise. Further, using the spring members 24 to support the support block 23 allows floating of the floating structure 13, increasing elastic displacement range, providing sufficient positive contact force, avoiding structural deformation or damage, enhancing overall structural stability and ensuring positive contact.

In the present preferred embodiment, the conducting terminals 21 of the contact conducting structure 2 are bonded to the respective contacts 221 of the flexible PC board 22. For allowing the conducting terminals 21 to be moved with the respective contacts 221 of the flexible PC board 22, the flexible PC board 22 is stamped to provide the slits 222 between each two adjacent contacts 221. Thus, when each individual conducting terminal 21 is pushed by a respective mating conducting terminal of a mating external electrical connector, the respective contact 221 of the flexible PC board 22 can be relatively moved without affecting contact stability. Further, the conducting terminals 21 can be respectively connected to the internal grounding structure of the flexible PC board 22 to create a common ground, enhancing high frequency characteristic performance to satisfy high-frequency characteristic application requirements.

Further, there is a structural design between the second sliding member 132 of the floating structure 13 and the fingers 232 of the support block 23 for limiting the displacement range when the conducting terminals 21 are individually activated. According to this structural design, the stop end portions 2322 of the fingers 232 are respectively inserted into the respective position-limiting slots 1323 in the position-limiting wall 1322. When the conducting terminals 21 are pushed, the position-limiting wall 1322 of the second sliding member 132 is forced into abutment against the spacer plates 111 of the front base 11. As the conducting terminals 21 are being continuously moved downwards, the fingers 232 are forced at the respective arched spring arms 231 against the respective spring members 24. Once the contact portions 212 are moved into flush with the part of the second sliding member 132 around the through holes 1321, a gap is provided between the stop end portion 2322 of each finger 232 and the respective position-limiting slot 1323 of the second sliding member 132 for limiting vertical displacement of the respective conducting terminal 21, ensuring working stability.

As described above, when the conducting terminals 21 are pushed, the fingers 232 of the support block 23 are forced downwardly against the respective spring members 24 and kept between the flexible PC board 22 and the spring members 24, preventing the spring members 24 from directly rubbing against the flexible PC board 22 to force the contacts 221 away from the respective conducting terminals 21 or to cause a short circuit. Further, the fingers 232 are supported on the respective arched spring arms 231 for biasing, avoiding stress concentration to damage the structure. The arch chamfer design of the large radius of curvature of the arched spring arms 231 mates with the flexibility of the flexible PC board 22 allows the flexible PC board 22 to be flexibly curved without causing damage.

As described above, the floating structure 13 of the electrically insulative housing 1 is exposed to the outside of the top open side of the accommodation chamber 10 between the front base 11 and the back cover 12; the contact conducting structure 2 is mounted in the accommodation chamber 10 with the conducting terminals 21 thereof respectively electrically bonded to the respective contacts 221 of the flexible PC board 22 the the fingers 232 of the support block 23 are respectively extended from the arched spring arms 231 and supported on the respective spring members 24 and abutted against one side of the flexible PC board 22 opposite to the conducting terminals 21 to give support to the flexible PC board 22. Further, the slits 222 of the flexible PC board 22 are respectively defined between each two adjacent contacts 221. Thus, the conducting terminals 21 can be independently biased with the respective contacts 221 of the flexible PC board 22 within a limited range, making the electrical connector practical for high frequency application.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

an electrically insulative housing comprising a front base, said front base comprising a plurality of spacer plates arranged in a row and a compartment defined between each two adjacent said spacer plates, a back cover fastened to said front base, an accommodation chamber defined between said front base and said back cover and a floating structure, said floating structure comprising a first sliding member and a second sliding member disposed in a top open side of said accommodation chamber, said second sliding member comprising a plurality of through holes arranged in a row and exposed to the outside of said first sliding member; and a contact conducting structure mounted in said accommodation chamber of said electrically insulative housing, said contact conducting structure comprising a plurality of conducting terminals, a flexible PC board, a support block and a plurality of spring members, each said conducting terminal comprising a base portion and a contact portion extended from said base portion and upwardly inserted through one respective said through hole of said second sliding member, said flexible PC board comprising a plurality of contacts arranged on one side thereof and respectively electrically connected to the said base portions and a slit defined between each two adjacent said contacts, said support block being mounted to an opposite side of said flexible PC board opposite to said conducting terminals, said support block comprising a plurality of arched spring arms and a plurality of fingers respectively horizontally extended from said arched spring arm corresponding to the respective said contacts, said spring members being respectively positioned in said compartments of said front base to elastically and movably support a respective bottom side of said fingers.

2. The electrical connector as claimed in claim 1, wherein said second sliding member of said floating structure of said electrically insulative housing is mounted in said first sliding member, comprising a position-limiting wall curving downwardly from a rear side of said second sliding member and a plurality of position-limiting slots defined in said position-limiting wall; said support block of said contact conducting structure comprises a spacing defined between each two adjacent said fingers corresponding to one respective said slit of said flexible PC board; each said finger further comprises a stop end portion inserted into one respective said position-limiting slot, said stop end portion can limit an interlaced route of each said finger movable up and down.

3. The electrical connector as claimed in claim 1, wherein each said conducting terminal of said contact conducting structure comprises said base portion, said contact portion of an inverted U-shaped portion, a turn-back portion connected between said base portion and said inverted U-shaped portion, and two abutment tips bilaterally extended from a distal end of said inverted U-shaped portion and stopped at a bottom side of one respective said through hole.

4. The electrical connector as claimed in claim 3, wherein said base portions of said conducting terminals are respectively soldered to and electrically connected to the respective contacts at a flexible PC board.

5. The electrical connector as claimed in claim 1, wherein said flexible PC board of said contact conducting structure further comprises two notches bilaterally disposed at a rear side relative to said slits; said support block comprises a plurality of arched spring arms arranged in a row and adapted for supporting said flexible PC board, and two protruding retaining portions respectively located on two opposite ends thereof below the elevation of said arched spring arms and respectively engaged into said notches of said flexible PC board; each said finger further comprises a mounting surface located on a top side thereof for the positioning of said flexible PC board.

6. The electrical connector as claimed in claim 5, wherein each said finger of said support block further comprises a positioning groove located on a bottom side thereof; each spring member comprises a first bearing portion horizontally disposed at a bottom side thereof, a second bearing portion horizontally disposed at an opposing top side thereof, a continuous S-shaped elastic portion connected between said first bearing portion and said second bearing portion, and an inverted U-shaped buckle end protruded from said second bearing portion and engaged in said positioning groove.

7. The electrical connector as claimed in claim 5, wherein said mounting surfaces of said fingers of said support block are respectively disposed corresponding the respective contacts of said flexible PC board and said conducting terminal; said flexible PC board is attached to said fingers of said support block and bonded to said mounting surfaces of said fingers with an adhesive.

8. The electrical connector as claimed in claim 1, wherein said front base of said electrically insulative housing further comprises a bottom open chamber defined in a bottom side thereof for the passing of said flexible PC board, and two guide rails arranged in parallel at two opposite sides of said bottom open chamber; said back cover comprises a positioning chamber for the positioning of said front base, a raised portion disposed in a rear side of said positioning chamber to face toward said bottom open chamber and two rail grooves respectively disposed at two opposite sides of said raised portion and adapted for receiving the respective said guide rails.

9. The electrical connector as claimed in claim 8, wherein said back cover further comprises a top abutment surface for said floating structure to expose to the outside of top side of said accommodation chamber, two upright stop walls respectively disposed at two opposite sides of said positioning chamber and abutted to said top abutment surface, and a concave surface located on a front side of said raised portion; a first sliding member of a floating structure comprises an elongated slot facing toward through holes, and two stop blocks respectively disposed at two opposite ends thereof and adapted for stopping against said upright stop walls of said back cover.

10. The electrical connector as claimed in claim 9, wherein said back cover further comprises two positioning posts respectively upwardly extended from said top abutment surface and respectively disposed at two opposite ends thereof; said raised portion of said back cover define with a bottom open chamber of a front base a gap for the insertion of a flexible PC board.

* * * * *